US005257484A

United States Patent [19]

Pergay et al.

[11] Patent Number: 5,257,484

[45] Date of Patent: Nov. 2, 1993

[54] SHELTERS FOR AUTOMATIC SNOW-COVERING INSTALLATIONS

[75] Inventors: Bernard Pergay, Sainte Foy les Lyon; Alain Steinmetz, Saint Herblain, both of France

[73] Assignee: York France S.A., Carouefou Cedex, France

[21] Appl. No.: 769,814

[22] Filed: Oct. 2, 1991

[30] Foreign Application Priority Data

Oct. 3, 1990 [FR] France ..... 90 12378

[51] Int. Cl.[5] ..... E04B 1/12; E04H 15/18

[52] U.S. Cl. ..... 52/63; 52/83; 135/96

[58] Field of Search ..... 52/20, 63, 83, 2.18, 52/2.19, 2.22, 169.5, 220; 135/91, 92, 96, DIG. 9, 116; 239/142, 200

[56] References Cited

U.S. PATENT DOCUMENTS 2,694,454 11/1954 Eickmeyer .
4,717,072 1/1988 Girardin .
4,883,512 11/1989 Griffis ..... 52/63 X

FOREIGN PATENT DOCUMENTS 2573854 5/1986 France .
2623276 5/1989 France .

*Primary Examiner*—Carl D. Friedman
*Assistant Examiner*—Kien Nguyen
*Attorney, Agent, or Firm*—Sandler Greenblum & Bernstein

[57] ABSTRACT

Shelter for snow-covering installations is provided with a prefabricated monobloc casing made of polyethylene type material obtained by rotational molding. This casing includes, at its lower part, elements for positioning and for directly anchoring to water and air pipes used to supply the snow guns. The bottom of the casing is provided with grooves enabling the casing to be positioned and centered on the water and air pipes. There is also provided a belt equipped with buckles for fastening of straps which provide connection between the shelter and the water and air pipes.

24 Claims, 2 Drawing Sheets

Fig - 1
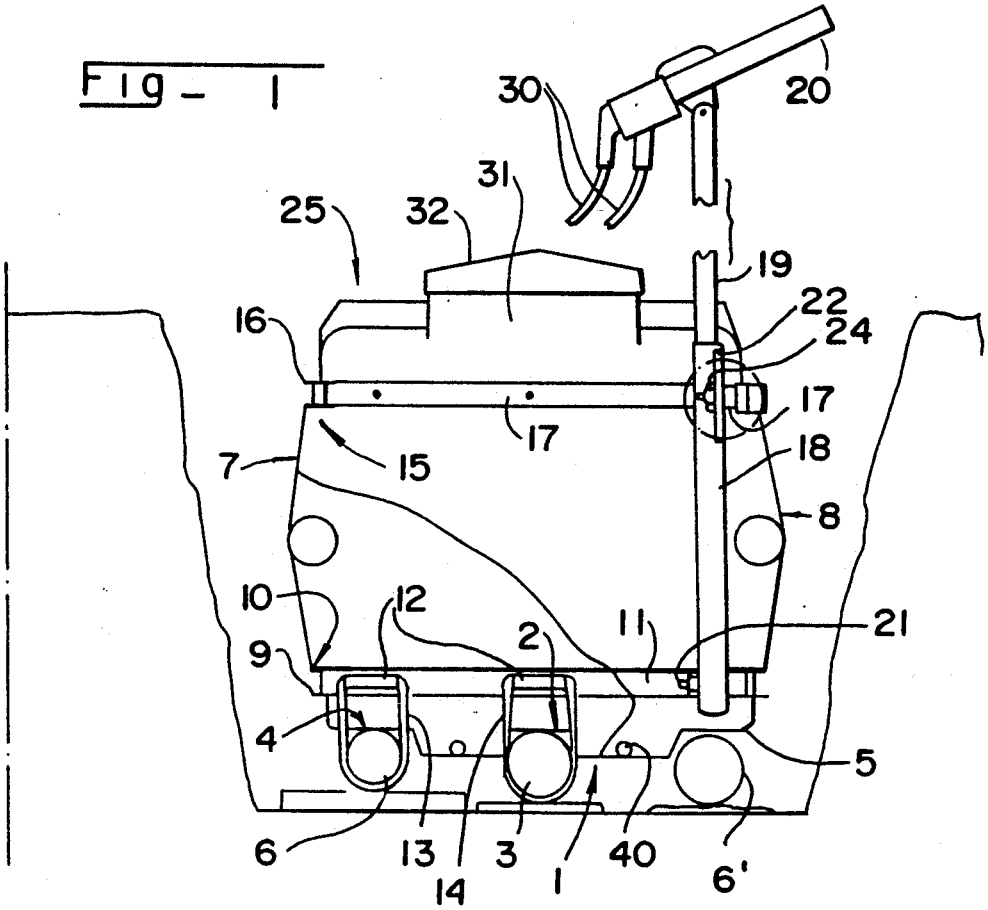
Fig - 1A
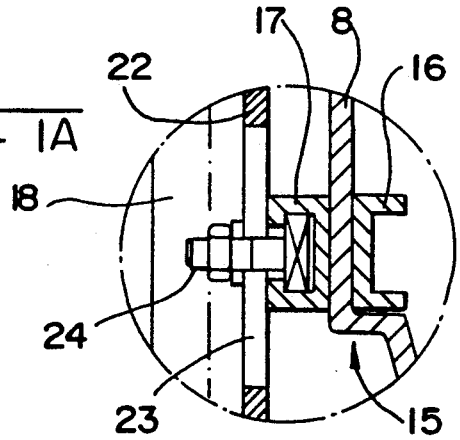
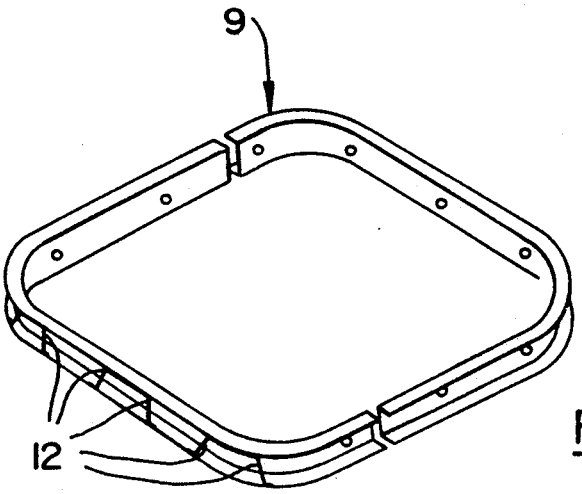
Fig - 4

SHELTERS FOR AUTOMATIC SNOW-COVERING INSTALLATIONS

BACKGROUND OF THE INVENTION

Field of the Invention

The present invention relates to shelters intended to protect automatic snow-covering installations and, more particularly, elements of these installations which are located on site and which form a connection between the snow gun or guns and the pipe or pipes used to supply them with water, and, depending on the type of gun, with compressed air.

Discussion of Background Information

The main aim of shelters for snow-covering installations is to protect the equipment which can supply and control the snow gun or guns. This equipment is particularly described in FR-A-2 573 854 and a model shelter is described in FR-A-2 623 276.

These shelters are arranged approximately every 30 to 50 meters, depending on requirements, and they can be buried in trenches.

The shelters used at present comprise a substructure made of concrete which requires work on site. This masonry work takes a relatively long time; in all cases, it requires the movement of materials and needs a considerable workforce.

SUMMARY OF THE INVENTION

The object of the present invention is to simplify on-site implementation by the use of finished light assemblies which eliminate all on-site masonry work.

A further aim of the invention is to standardize this type of shelter and to make it conform to the main requirements as regards dimensions, thermal insulation, strength and imperviousness. The shelter according to the invention also makes it possible to leave the supply valve of the snow gun permanently on site.

The shelter according to the invention is in the form of a prefabricated monobloc casing which encloses: the supply valve for the snow gun, the box or boxes for the electrical connections and the accessory equipment for connection to the snow gun, such as the supporting pole and the flexible connections. The shelter comprises means for positioning and for direct connection with at least one pipe for the supply of air and/or water, these means being constituted by contact surfaces and fastening devices.

According to a preferred embodiment of the invention the fastening devices are constituted by straps which permit a rapid and durable connection to be made between the shelter and at least one supply pipe; these straps are fixed to the shelter by means of buckles formed at the lower periphery of the shelter.

The shelter according to the invention is made from a plastic material of the polyethylene type obtained by rotational molding.

This shelter comprises reinforcements disposed at its upper part and its lower part, in the form of a belt, connected by bolting to an internal structure which is used for the positioning of the various devices enclosed in the shelter, as well as for the reinforcement of the shelter.

The use of a material such as polyethylene is especially suitable in that it allows on-site adaptation of the shelter and, in particular, a more convenient drilling of holes which are required for the connection to the supply pipes, and for the passage of the power and communication cables.

The shelter according to the invention further comprises, at its upper part, a reinforcement in the form of a projection for the passage of at least one supporting pole for the snow gun. This pole comprises means for anchoring to the internal rails, which means permit the fixing of the pole in a vertical position whatever the inclination of the shelter, when the shelter is fixed on the supply pipe or pipes.

The shelter according to the invention further comprises a manhole closed by a cover having hinges of a type made of rope covered with a nylon type of material in order to simplify its installation, and, in particular, to make it more reliable.

In order to avoid any intrusion into the shelter, the cover can be fitted with an inviolable lock.

BRIEF DESCRIPTION OF THE DRAWINGS

The invention will be further illustrated, without being limited in any way, by the following description of a particular mode of embodiment given as an example and represented in the appended drawings in which:

FIG. 1 is a general schematic front view of a shelter according to the invention, positioned on pipes, in a trench;

FIG. 1A is an exploded view showing adjustability of vertical positioning of the sleeve;

FIG. 4 represents the belt disposed at the lower part of the shelter, used particularly for anchoring the shelter on the air pipe and water pipe.

DETAILED DESCRIPTION OF THE PREFERRED EMBODIMENTS

Figure 2:
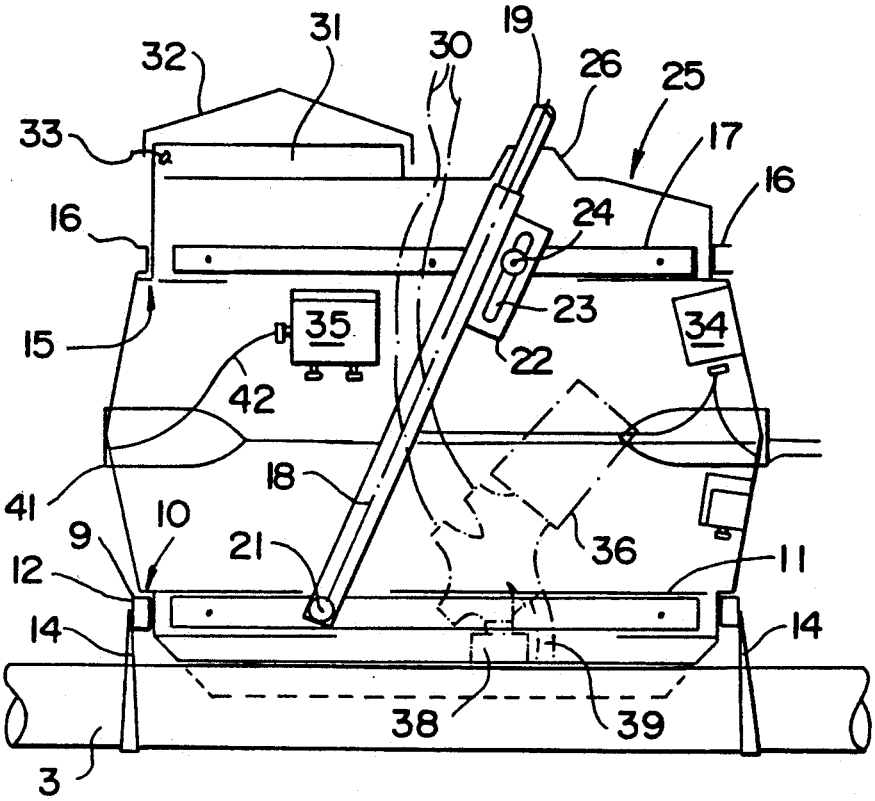
FIG. 2 is a side view, in cross-section, of the shelter according to the invention.

As represented in the figures, the shelter is in the shape of a parallelepiped made of a plastic material of the polyethylene type, molded by rotational molding. The space occupied by this parallelepiped is approximately that of a cube with a volume of the order of 1 $m^3$. A shelter of this type must be able to withstand temperatures ranging from −25° C. to +40° C. without damage.

This shelter comprises, in a general manner, drawing clearances, rounding of the reinforcements, minimum radii and limitation of any setting into a gel related to the manufacturing process.

This shelter is particularly constituted by a floor or bottom 1 which has housings used for positioning it on the pipe or pipes running alongside the piste. This bottom 1 has longitudinal grooves forming a central housings 2 for the water pipe 3 and two side housing 4 and 5 for the air pipe 6 which may be situated on one side or the other of the water pipe, depending on the particular case, and possibly alternating with a main drain 6' for discharged water.

The housing 2 consists of a groove which extends over the whole length of the bottom 1; this groove has a trapezoidal cross-section which enables the bottom 1 to be wedged on to the pipe 3. The housings 4 and 5 consist of grooves formed in the lower corners of the shelter between the bottom 1 and the side walls 7 and 8; the bottoms of these grooved housings are situated substantially in the same plane.

At the lower part of these side walls 7 and 8, above the housings 4 and 5, a metal belt 9 can be seen, which is represented in detail in FIG. 4. This belt 9 is made in two equal and symmetrical parts. The belt 9 reinforces the lower part of the shelter and is disposed in a step 10 formed in a lower part of the four sides of the shelter.

This belt 9 is lined internally by means of rails 11 positioned inside the shelter; the belt 9 is fixed firmly to the rails 11 by bolts or rivets.

The belt 9 in FIGS. 1 and 4 has a U-shaped cross-section, with the open end of the U facing outwards. Buckles 12 are welded between the upper and lower wings of the belt 9. These buckles 12 are used to anchor the straps 13 and 14, represented in FIGS. 1 and 2, which provide for the clamping and attachment of the shelter to the pipes 3 and 6.

The buckles 12 are in the form of a metal shank shaped into trapezia; they are fixed on the front and rear faces of the belt 9, i.e. on the faces which are situated above the pipes 3, 6 and 6'. It should be noted that the shelter can be fixed on to the single water pipe 3 in the absence of an air pipe. The adjustment into its stable position will be carried out by a wedge between the bottom and the ground.

The shelter also comprises, at its upper part, housed in a step 15 identical to the lower step 10, a second belt 16 with a U-shaped cross-section, lined internally by rails 17; these rails 17 are also attached, through the walls of the shelter, by means of bolts or rivets. This belt 16 is situated in a plane parallel to the plane of the lower belt 9. The upper belt 16 is also made in two equal and symmetrical parts.

The internal rails 11 and 17 have a U-shaped cross-section with closed-up edges. These rails 11 and 17 particularly make it possible to attach the equipment and, in particular, as represented in FIG. 1, the sleeve 18 which is used for the support and guidance of the pole 19 at the end of which a snow gun 20 is fixed. This pole is locked on to the sleeve by any suitable means. The sleeve 18 is anchored at its lower end on to the internal rail 11, by means of a bolt 21 whose head is locked in the rail 11. In FIGS. 1, 1A and 2, at the upper part of the sleeve, can be seen a flat bar 22 welded laterally and having an elongated slot 23 which allows the passage of a bolt 24 whose head is imprisoned in the internal upper rail 17. The inclination of the sleeve 18 can be adjusted, thanks to the elongated slot 23, so as to allow a vertical positioning of the pole 19 whatever the slope of the water and air pipes. Mounting the sleeve 18 on the rails 11 and 17 in cooperation with the belts 9 and 16, gives the sleeve high mechanical strength, which is necessary in view of the stresses and recoil forces created by the gun 20 and by the effects of wind, snow and ice.

It is possible, depending on the requirements, to position on the shelter two snow guns 20 supported on either side of the shelter by sleeves 18 fixed laterally by means of internal rails 11 and 17.

Figure 3:
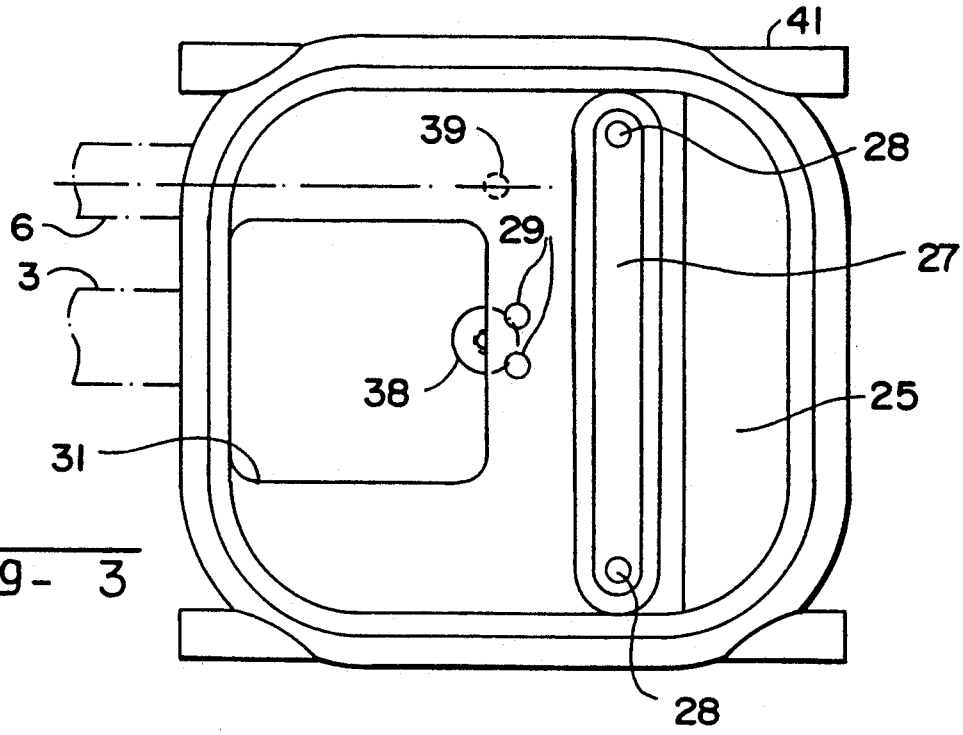
FIG. 3 is a plan view of the shelter alone.

The pole 19 passes through the ceiling 25 of the shelter in a zone reinforced by a projection 26. This projection 26 extends transversely over the whole ceiling 25, and comprises, as illustrated in FIG. 3, on each side of its upper flat surface 27, guiding holes 28 intended for the passage of poles 19 for supporting snow guns.

The ceiling 25 further comprises holes 29 for the passage of flexible pipes 30 used for supplying the gun or guns. A seal in the shape of a flexible washer is interposed between the ceiling 25 and the pipes 30. These holes 29 are situated substantially at the center of the ceiling 25, disposed on the same transverse line.

The ceiling 25 further comprises a manhole 31, in order to allow access to the inside of the shelter, with a view to carrying out the installation of the various components and their connection. This manhole 31 is closed by a cover 32. This cover 32 is connected to the side wall of the manhole by means of a rope 33 coated in plastic, each as nylon, forming a type of lacing so as to avoid the conventional disadvantages of metal hinges.

FIG. 2 shows boxes 34, 35 for electrical connections and valve 36 which controls the supply to the snow gun 20.

The valve 36 is connected to the air pipe 6 and water pipe 3 by short tapping pipes 38 and 39. These short tapping pipes pass through the bottom 1 of the shelter. The hole for the short water pipe 38 is preferably made before the shelter is mounted on the pipes; the hole for the short air tapping pipe 39 is preferably made on site.

In the same way, the holes 40 disposed in the bottom of the shelter in order to empty it are made on site, and the holes 40 are connected to the main drain 6' by flexible pipes.

Cylindrical sleeves 41 can also be seen, disposed in corners substantially half-way up the shelter. These cylindrical sleeves 41 allow, for example, the passage of the connecting cables 42 of the different electrical connections of the shelter with the electrical networks of the piste.

The assembly of the shelter on the pipes 3 and 6 is carried out very quickly by means of the straps 13 and 14 and a simple hoop-tightening tool. The straps are preferably made of polyester fibers.

The various connections are also carried out quickly, either through the holes already provided, or by the provision of holes or even by cutting through the wall of the shelter which is made for this purpose of an easily cuttable plastic material.

The structure of the shelter, substantially cubic in shape, fitted with belts 9 and 16 in the form of hoops, also enables it to withstand strong external stresses like earth pressures. Accidental damages caused by the passage of light tractors or ramming machines on the upper part of the shelter can be eliminated by installing a new upper cap embedded in and riveted on to the existing monobloc structure. Moreover, such a shelter can easily be made in a color which enables it to blend into the landscape, i.e. a greenish or stone color, for example.

We claim:

1. A shelter for snow-covering installations, which installations are located alongside skiing pistes including at least one pipe for connection to at least one snow gun, comprising:

a prefabricated casing, said casing including a bottom; and first means associated with said bottom of said casing for positioning said casing on at least one pipe and for connecting said bottom of said casing to the at least one pipe, said first means comprise at least one longitudinal groove along said bottom of said casing for cooperating with the at least one pipe.

2. The shelter according to claim 1, wherein said first means further comprise anchoring elements and connecting elements.

3. The shelter according to claim 1, wherein said bottom includes at least two grooves for positioning on and connecting to at least two pipes.

4. A shelter for snow-covering installations, which installations are located alongside skiing pistes including at least one pipe for connection to at least one snow gun, comprising:

a prefabricated casing, said casing includes a bottom; and first means associated with said bottom of said casing for positioning said casing on at least one pipe and for connecting said bottom of said casing to the at least one pipe, and said first means comprise at least one longitudinal groove for cooperating with the at least one pipe, anchoring elements comprising buckles associated with said casing, and connecting elements.

5. The shelter according to claim 4, wherein said connecting elements comprise at least one strap.

6. A shelter for snow-covering installations, which installations are located alongside skiing pistes including at least one pipe for connection to at least one snow gun, comprising:

a prefabricated casing, said casing including a bottom; and first means associated with said bottom of said casing for positioning said casing on at least one pipe and for connecting said bottom of said casing to the at least one pipe, and said first means comprise at least one longitudinal groove for cooperating with the at least one pipe, anchoring elements comprising buckles associated with said casing, and connecting elements comprising at least one strap having a length sufficient to wrap around the at least one pipe with ends of said at least one strap being attached to said buckles.

7. The shelter according to claim 6, comprising a first belt surrounding a lower portion of said casing, said first belt having at least one of opposite edges, and said buckles are positioned on said at least one pair of opposite edges.

8. A shelter for snow-covering installations, which installations are located alongside skiing pistes including at least one pipe for connection to at least one snow gun, comprising:

a prefabricated casing, said casing including a bottom; and first means associated with said bottom of said casing for positioning said casing on at least one pipe and for connecting said bottom of said casing to the at least one pipe, said first means comprise at least one longitudinal groove for cooperating with the at least one pipe; and a first belt surrounding a lower portion of said casing.

9. The shelter according to claim 8, wherein said first belt has a U-shaped cross-section.

10. The shelter according to claim 8, wherein said first belt is composed of metal.

11. The shelter according to claim 8, wherein said first belt includes buckles on at least one pair of opposite edges.

12. The shelter according to claim 11, further comprising a second belt surrounding an upper portion of said casing.

13. The shelter according to claim 12, wherein said second belt is positioned in a plane that is substantially parallel to a plane passing through said first belt.

14. The shelter according to claim 13, comprising a lower internal rail and an upper internal rail to which said first belt and said second belt are connected.

15. The shelter according to claim 14, comprising bolts or rivets for connecting said first belt to said lower internal rail and said second belt to said upper internal rail.

16. The shelter according to claim 15, comprising at least one sleeve for supporting and guiding a pole on which a snow gun is to be fixed, said at least one sleeve being affixed to said lower and upper internal rails.

17. The shelter according to claim 16, wherein said at least one sleeve comprises a laterally affixed bar at an upper portion, said bar comprising a slot for permitting adjustment of the at least one sleeve.

18. The shelter according to claim 17, wherein said bar comprises a flat bar.

19. The shelter according to claim 18, wherein said flat bar is welded to said at least one sleeve.

20. The shelter according to claim 16, comprising a ceiling at an upper portion of said casing, and a reinforced zone on said ceiling comprising a projection including at least one opening to permit the passage of at least one pole for at least one snow gun.

21. The shelter according to claim 20, comprising a manhole in said ceiling, and a cover for closing said manhole.

22. The shelter according to claim 21, comprising a coated rope for affixing said cover.

23. A shelter for snow-covering installations, which installations are located alongside skiing pistes including at least one pipe for connection to at least one snow gun, comprising:

a prefabricated casing, said casing including a bottom; and first means associated with said bottom of said casing for positioning said casing on at least one pipe and for connecting said bottom of said casing to the at least one pipe, and first means comprise at least one longitudinal groove for cooperating with the at least one pipe; and said casing comprises a monobloc casing of polyethylene obtained by rotational molding.

24. The shelter according to claim 23, wherein said casing comprises, at a central portion, cylindrical sleeves for passage of electrical connecting cables.

* * * * *